US008061926B2

(12) United States Patent
Riddell et al.

(10) Patent No.: US 8,061,926 B2
(45) Date of Patent: Nov. 22, 2011

(54) CRASH BARRIER BEAM

(75) Inventors: Mark Riddell, Bracknell (GB); Leslie J. Wall, Bracknell (GB); Peter J. Wilkinson, Brierley Hill (GB); John L. Addy, West Lothian (GB); Mark G. Reynolds, Staffs (GB)

(73) Assignee: Hill & Smith Limited, West Midlands (GB)

( * ) Notice: Subject to any disclaimer, the term of this patent is extended or adjusted under 35 U.S.C. 154(b) by 117 days.

(21) Appl. No.: 12/515,665

(22) PCT Filed: Nov. 21, 2007

(86) PCT No.: PCT/GB2007/004464

§ 371 (c)(1),
(2), (4) Date: Sep. 22, 2009

(87) PCT Pub. No.: WO2008/062196

PCT Pub. Date: May 29, 2008

(65) Prior Publication Data

US 2010/0061800 A1 Mar. 11, 2010

(30) Foreign Application Priority Data

Nov. 21, 2006 (GB) ..... 0623200.3

(51) Int. Cl.
*E01F 15/08* (2006.01)

(52) U.S. Cl. ..... 404/6; 256/13.1

(58) Field of Classification Search ..... 404/6; 256/13.1
See application file for complete search history.

(56) References Cited

U.S. PATENT DOCUMENTS

| | | | | | |
|---|---|---|---|---|---|
| 1,606,588 | A | * | 11/1926 | Meermans | 404/12 |
| 1,677,038 | A | * | 7/1928 | Lookabaugh | 256/13.1 |
| 3,308,724 | A | * | 3/1967 | Smith | 404/7 |
| 4,376,594 | A | * | 3/1983 | Prosenz | 404/6 |
| 4,423,854 | A | * | 1/1984 | Cobb et al. | 256/13.1 |
| 4,435,106 | A | * | 3/1984 | Forster et al. | 404/6 |
| 5,230,582 | A | * | 7/1993 | Schmitt et al. | 404/6 |
| D429,005 | S | * | 8/2000 | Risi | D25/113 |
| 6,428,237 | B1 | * | 8/2002 | Duckett | 404/6 |
| 6,474,904 | B1 | * | 11/2002 | Duckett et al. | 404/6 |
| 6,669,402 | B1 | | 12/2003 | Davis et al. | |

(Continued)

FOREIGN PATENT DOCUMENTS

AU 200172113 3/2002

(Continued)

*Primary Examiner* — Gary S Hartmann
(74) *Attorney, Agent, or Firm* — Gottlieb, Rackman & Reisman, P.C.

(57) ABSTRACT

A crash barrier beam (10) suitable for temporary placement on a road comprises a housing (18) which, in profile, has a laterally extending base (12) for contact with the road. The beam has a narrower central element (14) upwardly extending from the base that terminates in a top portion (16). The exterior of the housing provides a continuous impact surface to an oncoming vehicle and the profile provides stability to the beam on impact. The crash barrier beam (10) has a length defined by a first end (24) and a second end (26, 28). At least one of the first and second ends comprises formations (32, 34) for engagement with corresponding formations (38, 40) on an end of an adjacent beam (10') so as to facilitate joining of the beams to one another. The formations are configured for the beams to be substantially self-aligning with respect to each other.

7 Claims, 9 Drawing Sheets

U.S. PATENT DOCUMENTS

| | | | | |
|---|---|---|---|---|
| 6,848,857 | B1 | 2/2005 | McColl et al. | |
| 6,863,468 | B2 | 3/2005 | Davis et al. | |
| 7,168,882 | B1 | 1/2007 | Owen | |
| 7,172,362 | B2 | 2/2007 | Schmitt | |
| D574,510 | S * | 8/2008 | Riddell et al. | D25/38 |
| D574,511 | S * | 8/2008 | Riddell et al. | D25/38 |

FOREIGN PATENT DOCUMENTS

| | | |
|---|---|---|
| DE | 9101352 | 5/1991 |
| DE | 4038538 | 6/1992 |
| DE | 9317546 | 3/1994 |
| DE | 19619787 | 11/1997 |
| DE | 29817764 | 12/1998 |
| DE | 29908299 | 7/1999 |
| EP | 0428097 | 5/1991 |
| EP | 0 462 307 | 12/1991 |
| EP | 0462307 | 12/1991 |
| EP | 1 001 090 | 5/2000 |
| EP | 0997582 | 5/2000 |
| EP | 1001090 | 5/2000 |
| EP | 1 063 357 | 12/2000 |
| EP | 1063357 | 12/2000 |
| EP | 1380696 | 1/2004 |
| EP | 1384820 | 1/2004 |
| EP | 1384821 | 1/2004 |
| EP | 1 418 274 | 5/2004 |
| EP | 1418274 | 5/2004 |
| EP | 1 693 519 | 8/2006 |
| EP | 1693519 | 8/2006 |
| FR | 2613739 | 10/1988 |
| FR | 2733259 | 10/1996 |
| FR | 2 745 596 | 9/1997 |
| FR | 2745596 | 9/1997 |
| WO | WO2005085533 | 9/2005 |
| WO | WO 2007/036239 | 4/2007 |
| WO | WO 2007036239 | 4/2007 |
| WO | WO 2007148110 | 12/2007 |
| WO | WO 2008/040343 | 4/2008 |

* cited by examiner

CRASH BARRIER BEAM

The present invention relates to a crash barrier beam and, in particular but not exclusively, to interlocking crash barrier beams suitable for use as a temporary road barrier.

Crash barriers are provided along the centre or verge of vehicle carriageways for restraining impacting vehicles along their length, by absorbing energy from the collision. Whilst permanent crash barriers are provided on motorways, for example, it may be desirable in some situations, perhaps during road works, to provide temporary crash barriers to section off a part of a road or a hazard in the road.

Permanently deployed crash barriers are designed to withstand collisions and restrain errant vehicles, some of the impact energy being absorbed by the supporting posts, which are set into the ground. This is harder to achieve with temporary crash barriers, as it is sometimes desirable to deploy these without securing them to the bed of the road by pins or the like. There is also a need to balance barrier strength and stability with ease of assembly on site and the desire to keep costs of manufacture and assembly down. There is therefore a need to provide an improved road crash barrier which can be temporarily deployed. The present invention has been devised with the foregoing in mind.

Figure 0:
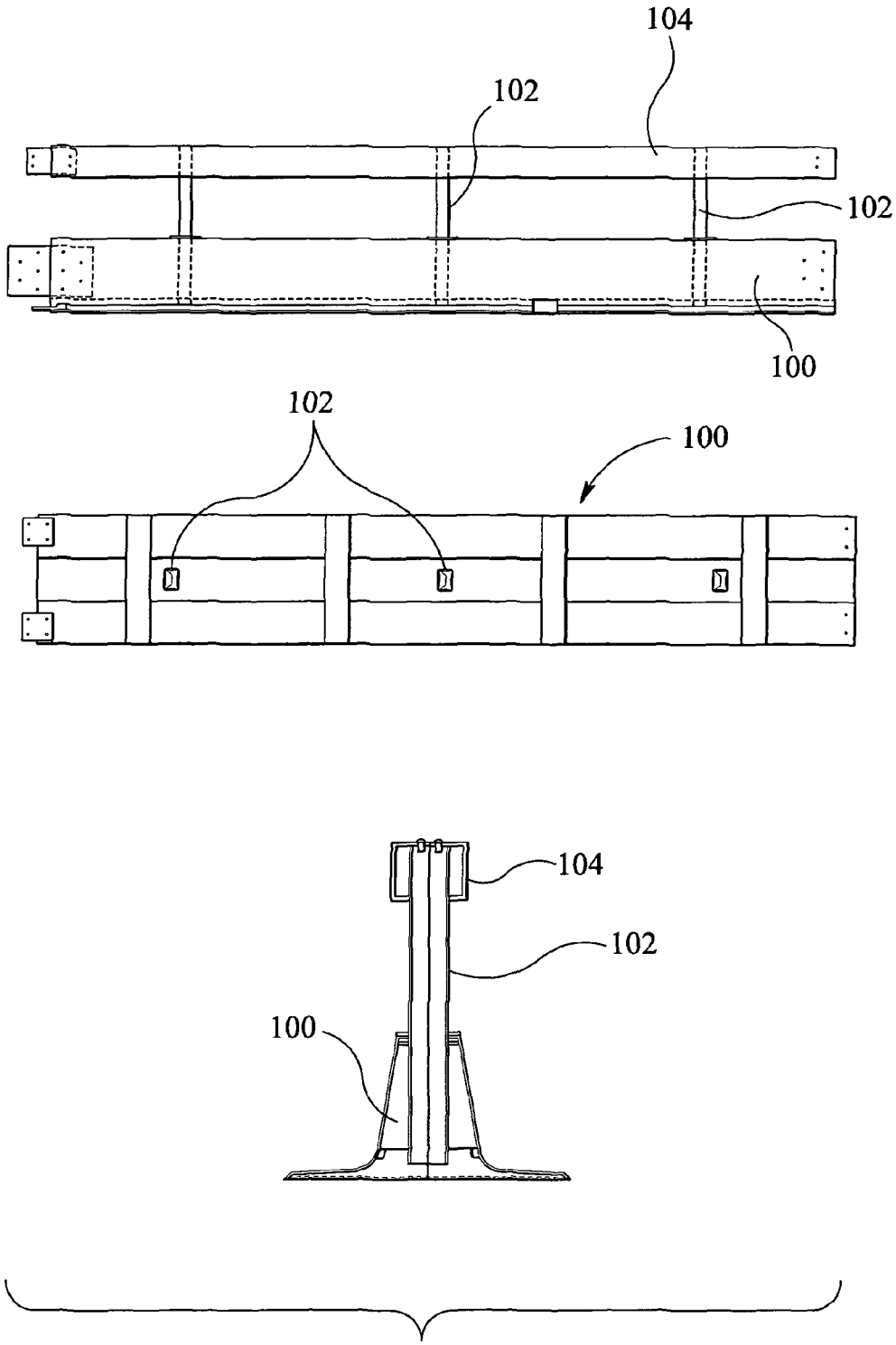

A known temporary road barrier shown in FIG. 0 comprises a base 100 that rests on a road surface, the base having spaced apart posts 102 extending vertically therefrom to a top rail 104. For vehicles such as pick-up trucks, which are built on chasses, the chassis rails of a pick-up truck may engage with the vertical posts of the known barrier on impact, causing unwanted deflection of the barrier. These known barriers are also expensive to manufacture and difficult to deploy.

According to a first aspect of the present invention, there is provided a crash barrier beam suitable for temporary placement on a road, the beam comprising a housing which in profile has a laterally extending base for contact with the road and a narrower central element upwardly extending therefrom to terminate in a top portion, wherein the exterior of the housing provides a continuous impact surface to an oncoming vehicle and the profile provides stability to the beam on impact.

It is an advantage that the profile of the crash barrier beam—i.e. a narrow central element and a wider base—provides stability to the beam since the beam has a low centre of gravity and a vehicle wheel riding up onto the base will assist in stabilising the beam against deflection thereof. Furthermore, the profile allows the beam to be deployed closer to traffic than known prior art barriers. The continuous impact surface is particularly adapted for restraining and redirecting impacting vehicles such as pick-up trucks, whose chassis rails could otherwise engage with posts of known barriers.

Preferably, the impact surface between the base and top portion is substantially planar in profile with a deflection along the length of the beam for providing stiffness to the housing. More preferably the top portion extends laterally away from the beam relative to the central element adjacent thereto to form a step running along the length of the beam. The gradient of the impact surface may be such that an impacting vehicle wheel is restrained in a vertical direction by said step.

The overall profile advantageously assists in redirecting vehicle wheels back onto the carriageway and reduces the chance of vehicles lifting on impact with the barrier (compared with known barriers).

In an embodiment, the top portion is substantially rectangular in profile. Preferably, the housing is hollow.

One or more strengthening webs, linkages or bars may span the internal space between opposite sides of the central element of the housing. The webs may be shaped to fit the internal profile of the central element of the housing, with parts cut away to keep the weight of the webs down and enable the barrier to crumple to absorb energy in the event of an impact. Alternatively, one or more solid profile stiffening webs may be provided, shaped to fit the internal profile of the central element of the housing.

In a preferred embodiment, the profile is formed from opposing mirror image sheets of metal, secured together at the top portion of the housing. It is an advantage that the profile is continuous, and formed from a single sheet of metal, thus facilitating manufacture and minimising weaknesses in the construction. The opposing sheets of metal or steel may be joined (preferably by welding) so as to provide a flush surface on top of the top portion of the housing. Forming the body of the beam in this way advantageously keeps the manufacture simple and the cost thereof to a minimum.

The laterally outwardly extending base portion may terminate in an inwardly extending return portion for supporting the beam on the road, defining a cavity between the outwardly extending base portion and the return portion.

The beam may further comprise one or more feet provided on the underside thereof for placement on a road surface. Preferably, one or more rubber feet are bonded to the underside of the one or more feet. Conveniently, the one or more rubber feet substantially extend across the width of the base of the beam. In an embodiment, the feet and/or the rubber feet comprise one or more openings for enabling the beam to be fixed to a road surface. Preferably, the one or more openings are elongate along the direction of the length of said road, so as to allow for expansion/contraction of the road due to changes in temperature. The rubber feet may comprise one or more recesses or indentations for facilitating even contact with the road surface. The base of the beam and/or the one or more feet comprise drainage channels that enable water to pass from one side of the beam to the other. The one or more feet may comprise an aperture for use with lifting equipment, whereby said beam can be lifted via said aperture.

Advantageously, the rubber feet increase the frictional grip of the beam with the road thus reducing deflection of the barrier during impact. Furthermore, the rubber feet assist in spreading the load (of the beam and any impacting vehicles) across the road and reduce the chance of the metal beam sinking into the road surface (which can be problematic in countries with hot climates).

In an embodiment, the beam is provided with a plurality of lifting means enabling lifting of the beam. Advantageously any form of lifting equipment can be used, e.g. forklift trucks or lifting by chains, lifting straps etc. The lifting means are preferably configured to facilitate lifting of the beam into position from any orientation of the beam. Preferably, the lifting means are located on or within the top portion and/or base portion of the beam.

The beam has a length defined by a first end and a second end. In an embodiment, at least one of the first and second ends comprises formations for engagement with corresponding formations on an end of an adjacent beam so as to facilitate joining of the beams to one another. Desirably, the formations are configured for the beams to be substantially self-aligning with respect to each other. It is an advantage that adjacent beams can be easily joined together, without the need for additional tools or loose component parts (e.g. nuts and bolts).

In a preferred embodiment, the first end of the beam is provided with one or more male connectors engageable within respective one or more female connectors provided on a second end of another beam. The one or more male connectors and respective one or more female connectors are provided along substantially the full height of the beam. This advantageously reduces the risk of adjacent beams becoming separated on impact by an errant vehicle. Additionally, the beam may further comprise one or more male connectors provided at the base of the first end of the beam, the male connectors being engageable within one or more female connectors provided at the base of a second end of an adjacent beam. Any or all of the male connectors may comprise a j-shaped connector engageable within a corresponding j-shaped female connector. Conveniently, the male and female connectors are of substantially the same configuration, and mounted in a mirror-image fashion on their respective beam ends with respect to each other, so as to be engageable within each other. This advantageously facilitates manufacture and construction/installation of the beam. In an embodiment, the female connector protrudes from the end of the housing of the first end of the beam and the male connector is housed substantially within the second end of the beam. The ends of the beam are advantageously configured such that the exterior surfaces of adjacent beams are flush with respect to each other on attachment.

Each of the female and male connectors may be mounted on jointing assemblies secured at the first and/or second ends of the beam. Preferably, and advantageously, the jointing assemblies for each of the male and female connectors are substantially identical. The jointing assemblies may be substantially flat and comprise a central plate spanning the space between the walls of the housing and a toe sized to fit within said cavity. Preferably, the plate and toe are integrally formed or fixed together. Portions of the plates may be cut away, to facilitate energy absorption by the beam in the event of an impact. The toes may conveniently be formed from the cut away parts of the plate. In an alternative embodiment, separate toe infills may be provided to provide additional strength and rigidity to the base of the beam.

A first beam may be provided, at its first end, with one or more male connectors engageable within respective one or more female connectors provided on an end of another beam. The second end of the beam is preferably provided with a jointing assembly securable to a like jointing assembly provided on another beam.

A second beam may be provided, at its first end, with one or more female connectors engageable within respective one or more male connectors provided on an end of another beam. The second end of the beam is preferably provided with a jointing assembly securable to a like jointing assembly provided on another beam.

A third beam may be provided, each end of which is provided with a jointing assembly securable to a like jointing assembly provided on another beam.

The jointing assemblies of any or all of the first, second and third beams are preferably substantially flat and comprise a central plate spanning the space between the walls of the housing and a toe sized to fit within said cavity. It is an advantage that like jointing assemblies can be utilised for each of the first, second and third beams. Preferably, the plate and toe are integrally formed or fixed together. Portions of the plates may be cut away, to facilitate energy absorption by the beam in the event of an impact. The toes may conveniently be formed from the cut away parts of the plate. In an alternative embodiment, separate toe infills may be provided to provide additional strength and rigidity to the base of the beam.

A barrier section may comprise the first beam, the second beam, and one or more third beams provided therebetween. The third beams may be secured together via respective jointing assemblies. Each free end of the group of joined third beams may be secured with jointing assemblies to jointing members of the first and second beams.

A barrier may comprise a plurality of such barrier sections, the one or more male connectors of a first beam being engageable with the one or more female connectors of a second beam.

It is an advantage that a length of barrier can be constructed from any combination of first, second and third beams, and barrier sections, depending on the situation. Any number of third beam sections may be provided between the first and second beams, or a first beam may be connected straight to a second beam. The groups of beam may be joined together off site (e.g. in a factory) or on site during construction of the barrier. A barrier may alternatively only comprise a series of third beams joined together.

One or more gussets may be provided where two beams are connected at their respective jointing assemblies. The gussets advantageously provide a flow path for distributing force from an impact up and/or down the length of the beam and/or barrier in the event of an impact thereon.

In an embodiment, a locking unit is provided for securing two adjacent beams together. Preferably, the locking unit is slidable between the housings of adjacent beams. The beams may thus be secured together when the locking unit bridges the junction between adjacent beams. The locking unit may initially be completely housed within the housing of one beam without protruding beyond the edge of the housing. Instead of, or in addition to the locking unit, an insert may be provided within the end of the hollow top portion, to strengthen the beam. It is an advantage that the stiffened top portion and the stable base strengthen the whole beam structure.

According to a second aspect of the present invention, there is provided a crash barrier beam suitable for temporary placement on a road, the beam having a length defined by a first end and a second end, at least one of the first and second ends comprising formations for engagement with corresponding formations on an end of an adjacent beam so as to facilitate joining of the beams to one another, the formations being configured for the beams to be substantially self-aligning with respect to each other.

It is an advantage that adjacent beams are easily joined together, without the need for additional tools or loose component parts (e.g. nuts and bolts).

Preferably, the first end of the beam is provided with one or more male connectors engageable within respective one or more female connectors provided on a second end of another beam. Alternatively, the first end of the beam is provided with one or more flanges engageable within respective slots provided on an end of the adjacent beam. The one or more male and female connectors/flanges and respective slots may be provided along substantially the height of the barrier to reduce the risk of adjacent housings becoming separated on impact by an errant vehicle. The ends of the beam may be configured such that the exterior surfaces of adjacent barrier sections are flush with respect to each other on attachment.

It is an advantage that incorporating the male and female connectors/flanges into the joint between adjacent beams increases the joint stiffness and strength, and therefore this reduced the chance of the beam deflecting when a vehicle impacts thereon.

In an embodiment, the beam comprises laterally extending base portions for supporting the beam on the road. The base portions may be provided with one or more connectors (e.g.

interengaging connectors)/flanges for engaging respective connectors/slots provided in the base portions of an adjacent beam.

According to a third aspect of the present invention, there is provided a crash barrier beam suitable for temporary placement on a road, the beam comprising a housing which in profile has a laterally outwardly extending base portion and a return portion for supporting the beam on the road, a cavity being defined between the outwardly extending base portion and return portion, wherein the cavity comprises an infill for increasing the strength of the barrier. Preferably, the outwardly extending base portion and the return portion are integrally formed from sheet metal.

It is an advantage that the infill reinforces the beam housing where it would otherwise be vulnerable to damage from the road and impacting vehicles, as well as helping to maintain the profile of the housing.

According to a fourth aspect of the present invention, there is provided a metal crash barrier beam suitable for temporary placement on a road, the beam comprising a housing which in profile has a laterally extending base portion and a narrower top portion, wherein one or more rubber feet are bonded to the underside of the base of the housing.

Preferably, the one or more rubber feet substantially extend the width of the base.

Advantageously, the rubber feet increase the frictional grip of the beam with the road thus reducing deflection of the barrier during impact. Furthermore, the rubber feet assist in spreading the load (of the beam and any impacting vehicles) across the road and reduce the chance of the metal beam sinking into the road surface (which can be problematic in countries with hot climates).

According to a fifth aspect of the present invention, there is provided a crash barrier beam suitable for temporary placement on a road, the beam comprising a housing which in profile has a laterally extending base portion and a narrower top portion, wherein the beam is provided with a plurality of lifting means for lifting the barrier section and lifting means are configured to lift the barrier section into position from any orientation of the beam.

Figures 1A, 1B:
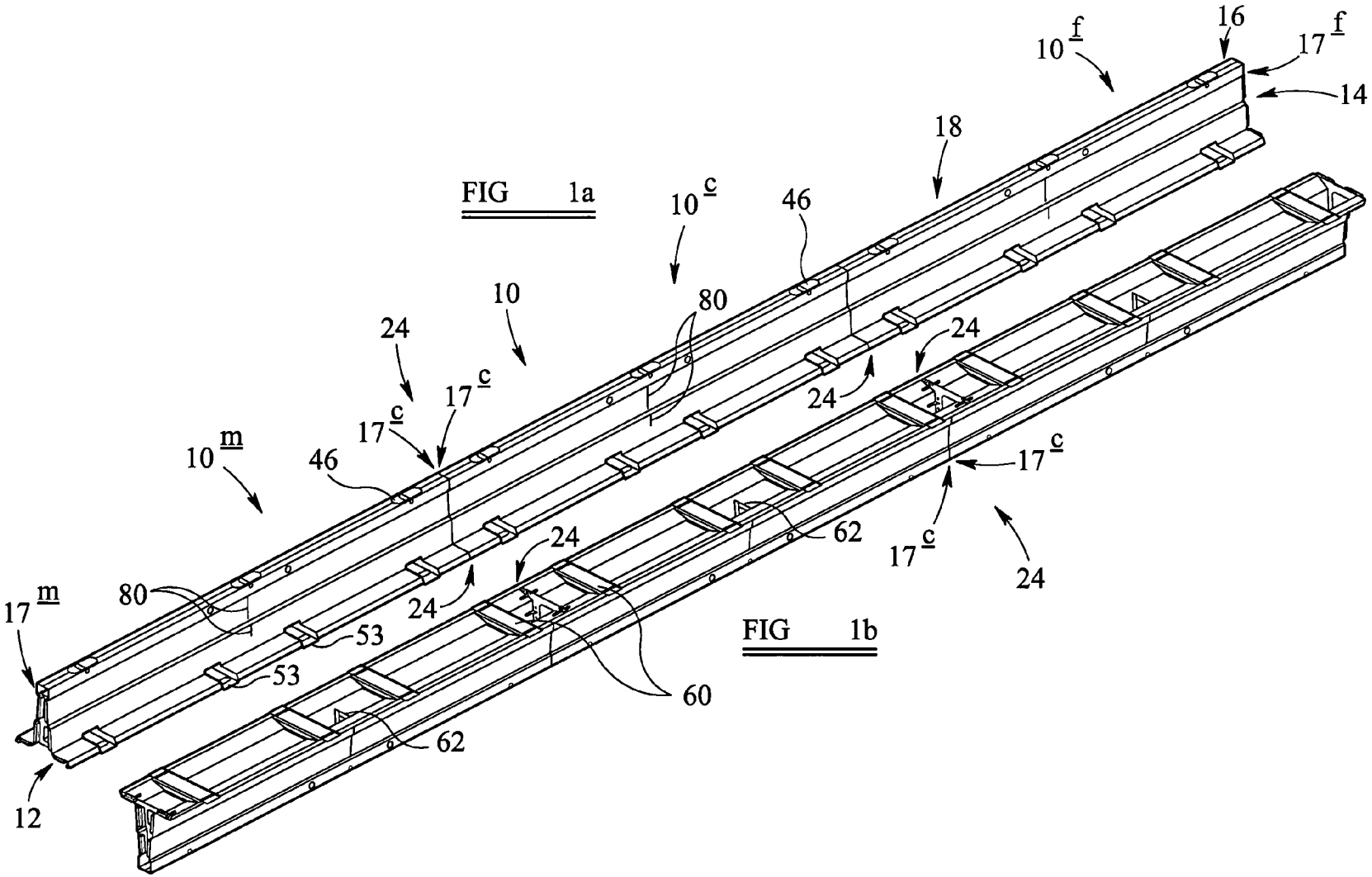
Figure 2:
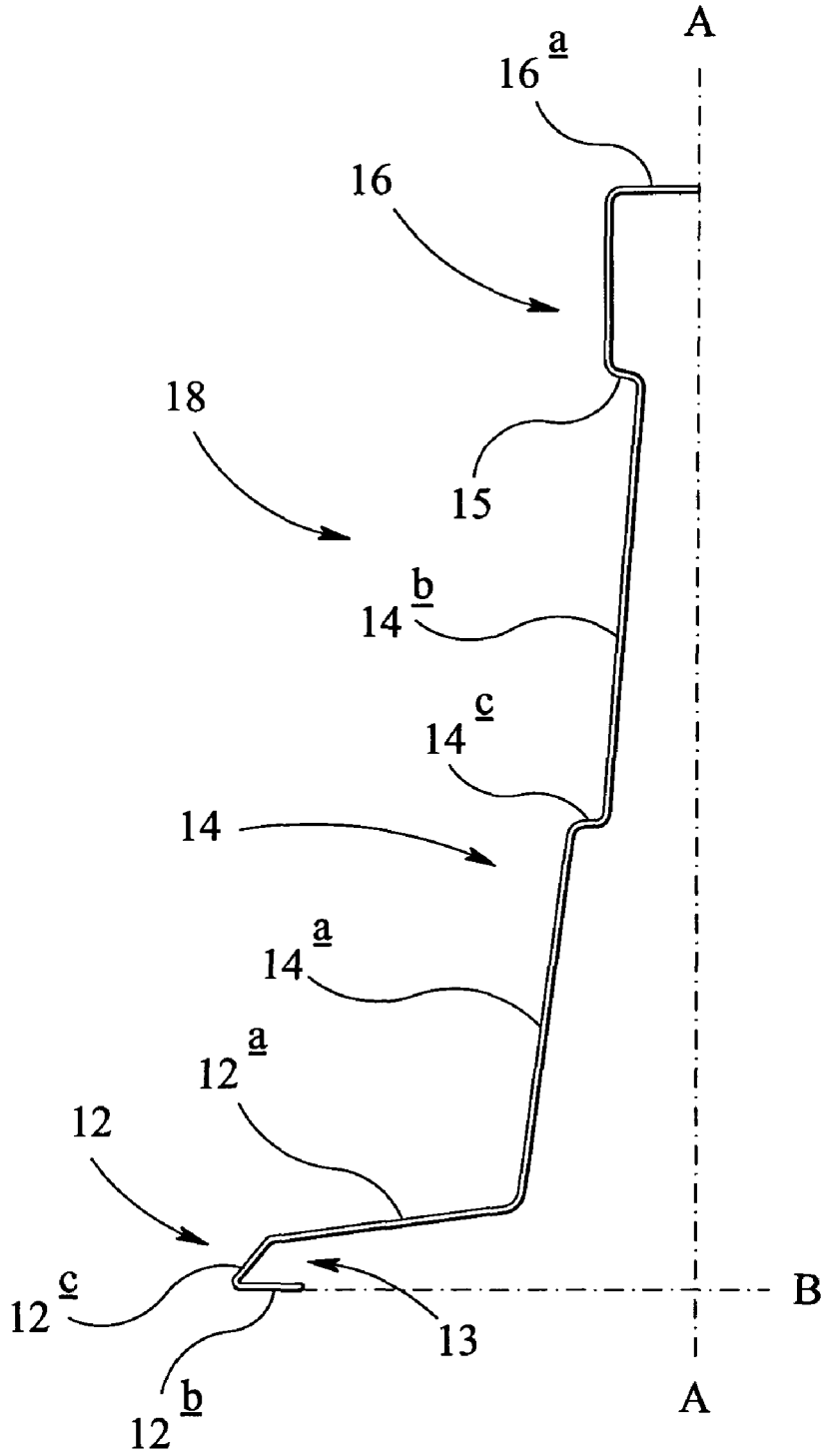
Figures 3A, 3B:
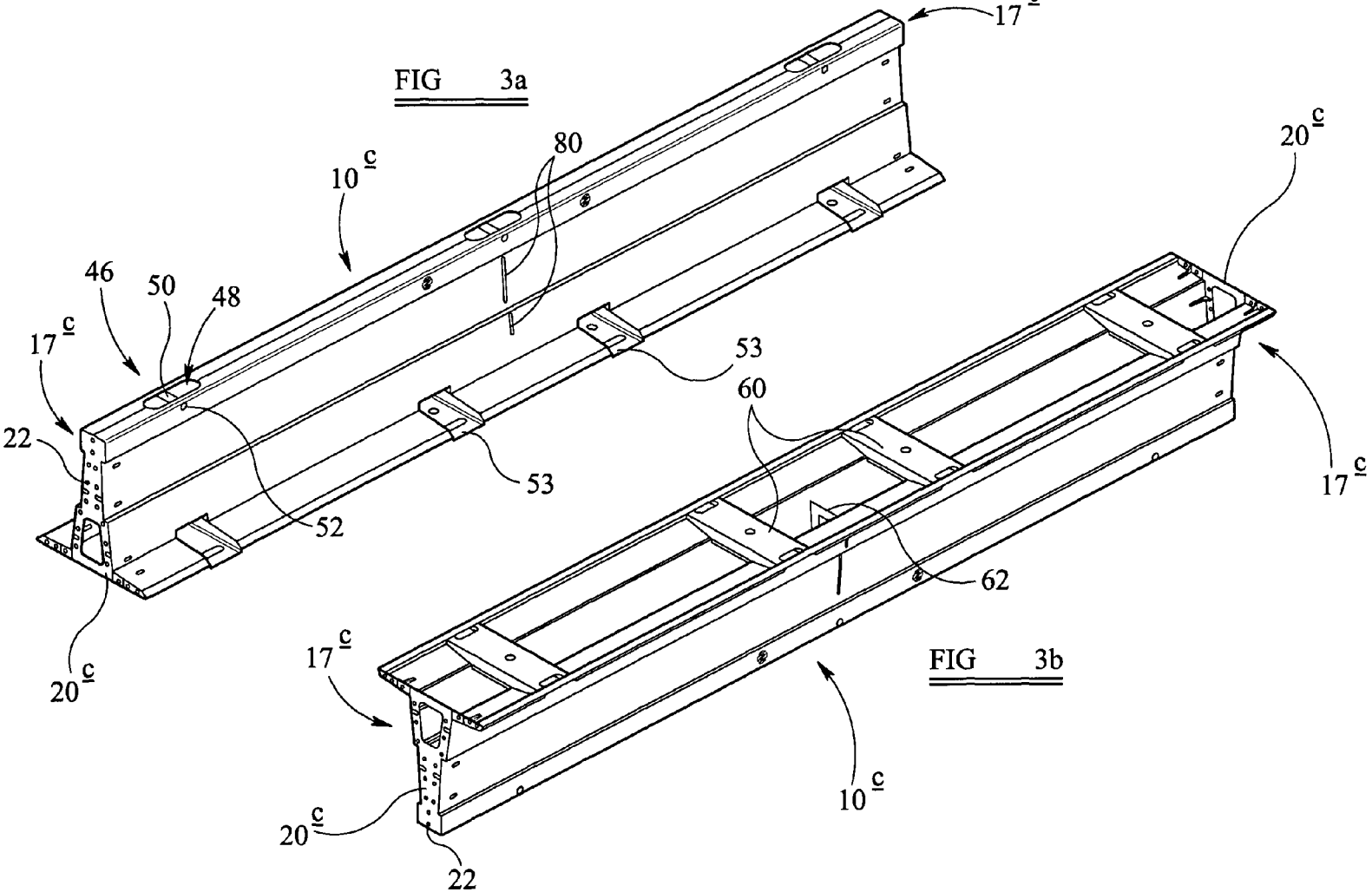
Figure 6B:
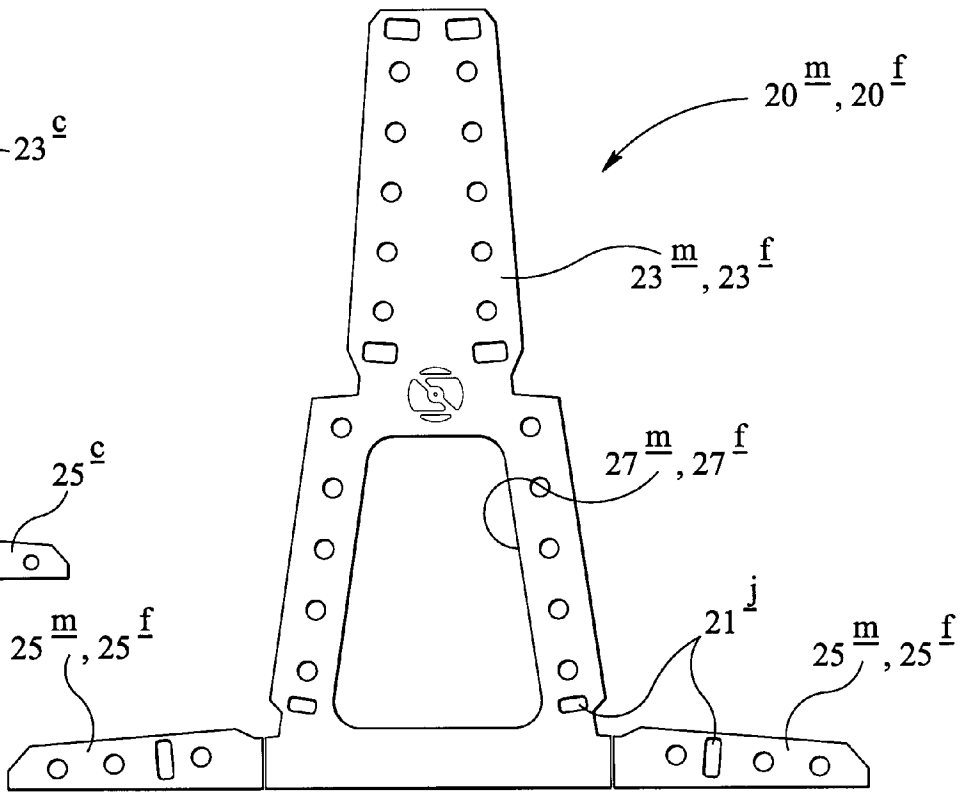
Figure 6A:
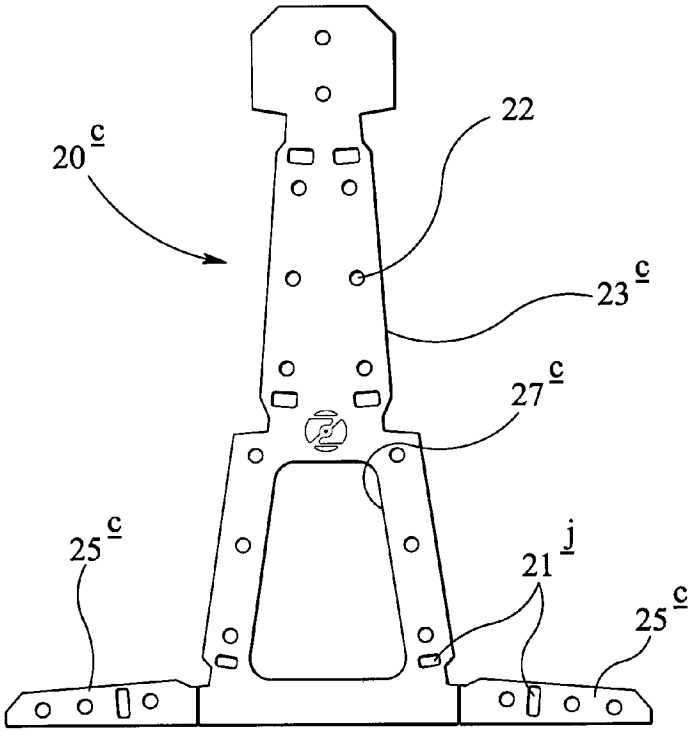
Figure 7B:
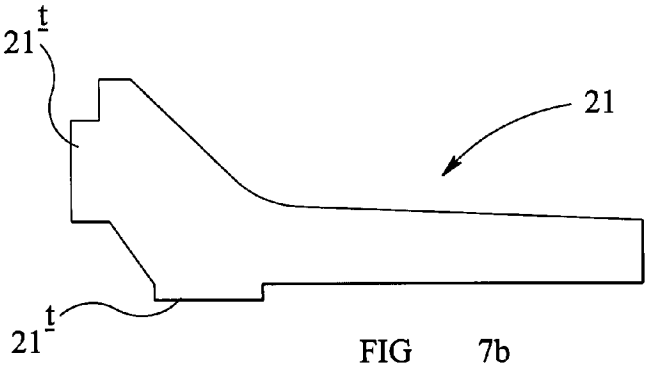
Figure 7A:
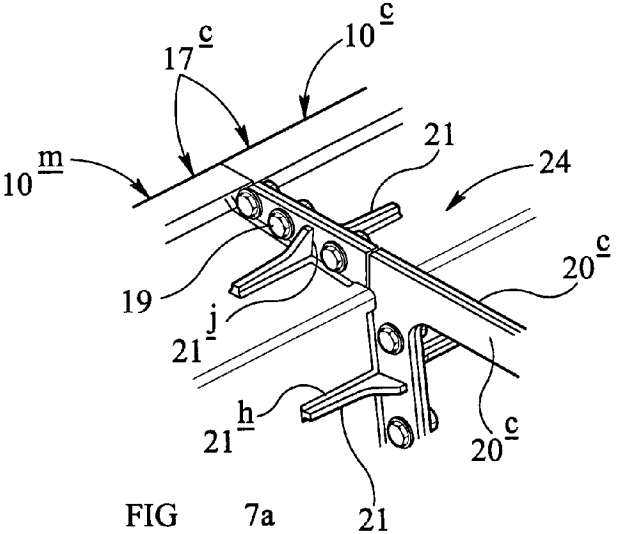

The lifting means are preferably located on or within the top portion and/or base portion of the barrier section. Advantageously any form of lifting equipment can be used, e.g. forklift trucks or lifting by chains, lifting straps etc. Embodiments of the invention will now be described by way of examples with reference to the drawings, in which:

FIG. 0 shows end, side and underneath views of a prior art temporary crash barrier;

FIGS. 1*a* and 1*b* are isometric views of a crash barrier beam according to an embodiment of the present invention;

FIG. 2 is a representation of one half of the profile of a crash barrier beam according to an embodiment of the present invention;

FIGS. 3*a* and 3*b* are isometric views of a central crash barrier beam section according to an embodiment of the present invention;

FIGS. 4*a* to 4*d* show a female end crash barrier beam section according to an embodiment of the present invention;

FIGS. 5*a* to 5*d* show a male end crash barrier beam section according to an embodiment of the present invention;

FIGS. 6*a* and 6*b* show jointing plates that can be incorporated into embodiments of the present invention;

FIG. 7*a* is a detailed view of the junction between the central beam of FIGS. 2*a* and 2*b* and an adjacent end beam section;

FIG. 7*b* shows a gusset that can be used at the junction shown in FIG. 7*a;*

Figure 9A:
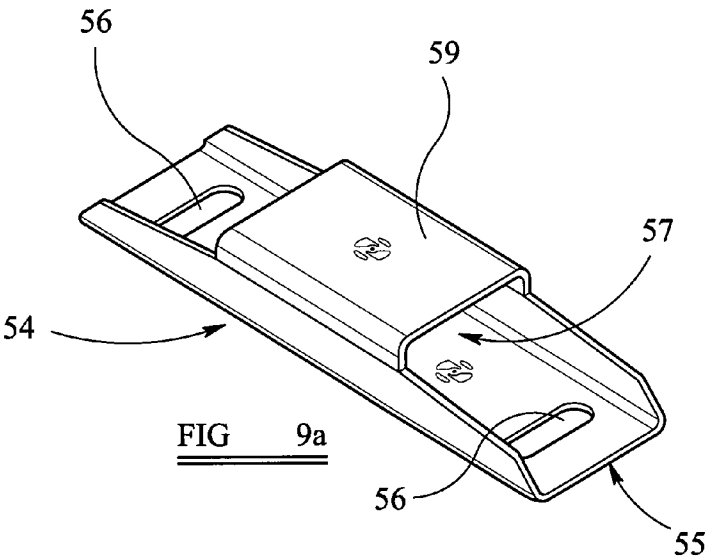
Figure 8:
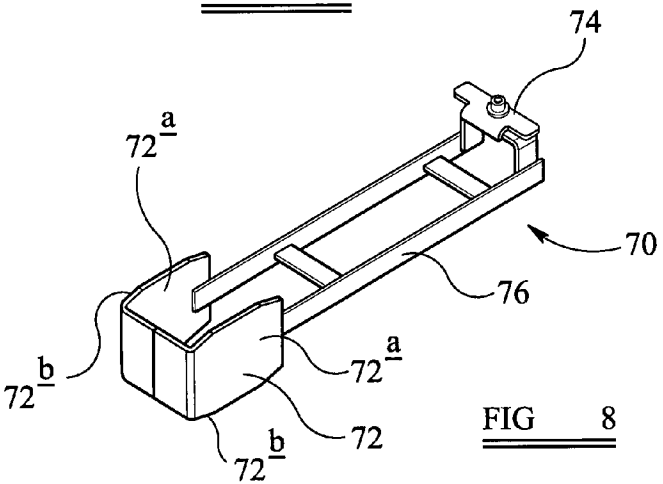
Figure 9B:
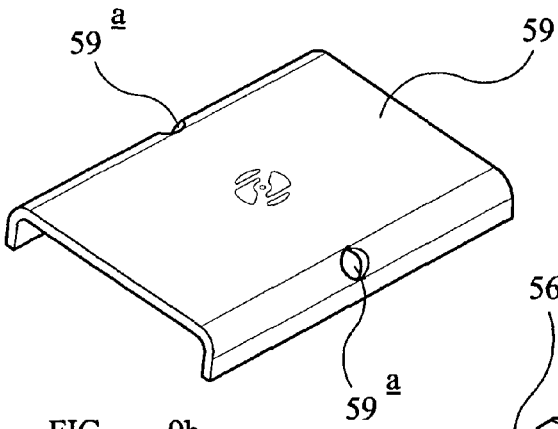
Figure 9C:
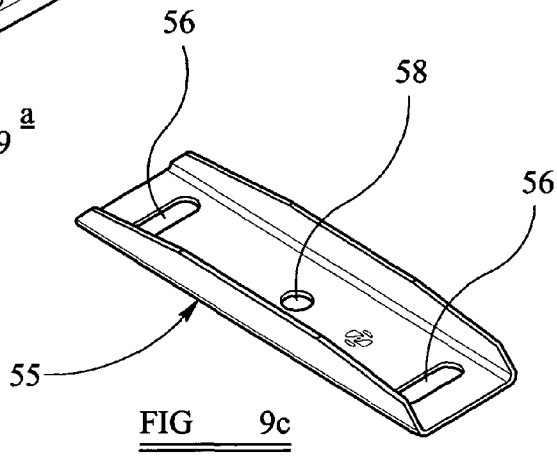
Figure 10:
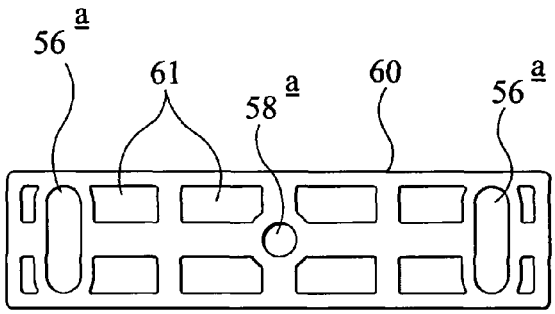
Figure 11:
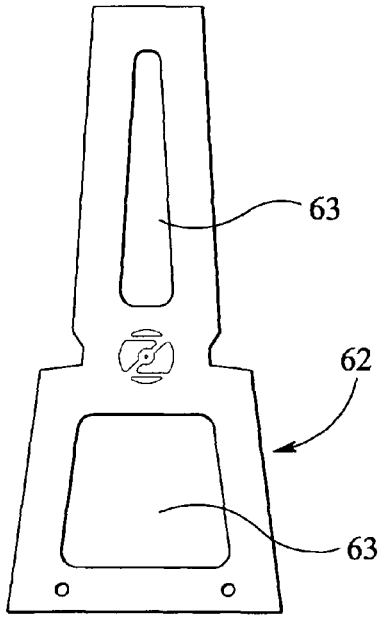

FIG. 8 shows a locking unit that can be incorporated into embodiments of the present invention;

FIGS. 9*a* to 9*c* show, in assembled and unassembled form, a lifting point for a crash barrier beam according to an embodiment of the present invention;

FIG. 10 shows a rubber foot that can be incorporated into embodiments of the present invention; and FIG. 11 shows a strengthening web that can be incorporated into embodiments of the present invention.

Referring to FIGS. 1*a* and 1*b*, an elongate 'Zoneguard®' crash barrier beam 10 is shown. The beam 10 has a base 12 that generally extends laterally with respect to the length of the beam 10. A narrower central wall 14 is upwardly extending from the base 12. The wall 14 has a form generally of an inverted V-shape tapering towards a top section 16. The top section 16 preferably has a box-like cross section. Together, the base 12, wall 14 and top box 16 form a hollow housing 18. By way of example, the housing may have a height of 0.8 m, the width of the largest part of the base being 0.6 m and the top box section may have a width of 0.13 m. In an alternative embodiment, the width of the largest part of the base is substantially 0.7 m and the top box section is substantially 0.16 m.

The beam 10 is preferably comprised of a central beam section 10*c*, and two end beam sections 10*m*, 10*f* located either side thereof. In the embodiment shown in FIGS. 1*a* and 1*b*, ends 17*c* of the central beam section 10*c* are each provided with a flat joint assembly 20*c* secured to the housing 18 e.g. by welding. The joint assembly 20*c* (see e.g. FIGS. 3*a*, 3*b*) is securable to a similar assembly 20*c* provided at a first end 17*c* of an end beam section 10*m*/10*f*. In the embodiment shown, the end assemblies 20*c* of the central and end beam sections 10*c*, 10*m*/10*f* can be secured together with bolts 19 via corresponding apertures 22 (see also FIGS. 4*c* and 5*c*) to form a joint or junction 24, as shown in FIGS. 1*a*, 1*b* and 7*a*. This provides the advantage that the connecting bolts 19 are concealed (and cannot therefore be easily dislodged in the event of an impact or otherwise). The use of flat joint assemblies 20*c* means that the edges of the first ends 17*c* of the beams 10*c*, 10*m*/10*f* meet so that the outer surfaces of adjacent beams 10*c*, 10*m*/10*f* are flush with respect to each other.

The beam 10 of FIGS. 1*a* and 1*b* is comprised of a first end beam section 10*m* joined to a central beam section 10 which, in turn, is joined to a second send beam section 10*f*. A second end 17*m* of the first beam section 10*m* is configured to interlock with a second end 17*f* of the second end beam section 10*f*. This enables multiple beams 10 to be secured together to form the full length of crash barrier required, as will be described in greater detail below.

In a preferred embodiment, the three beam sections 10*m*, 10*c*, 10*f* are each of 4 m in length, and joined together to form a beam 10 that is 12 m in length. The second end 17*m* of the first end beam section 10*m* is provided with male connectors interlockable with corresponding female connectors on the second end 17*f* of the second end beam section 10*f* (or the male/female connectors may be provided on the second/first end beam 10*f*/10*m*). This allows one beam 10 comprising three such beam sections 10*m*, 10*c*, 10*f* to be connected to another beam comprising another three such beam sections 10*m*, 10*c*, 10*f*. In another preferred embodiment, the three beam sections 10*m*, 10*c*, 10*f* are each of 5.08 m (16.67 feet) in length, and joined together to form a barrier section 15.24 m (50 feet) in length.

It will be appreciated that other configurations of beam sections with flat joint assemblies and/or interlocking connectors can also be utilised. In an alternative embodiment (not shown), there is no central beam section 10*c*, but two end sections, a male beam section 10*m* and a female beam section 10*f*, are joined together at their first ends 17*c* via assemblies 20*c* in a manner similar to that described above and are interlockable at their second ends 17*m*, 17*f* via interengaging connectors. Each beam section 10*m*, 10*f* may have a length of 7.5 m and so the barrier section 10 has a length of about 15 m. It will further be appreciated that other beam lengths are contemplated, for example in the range 5-10 m. Alternatively, a plurality of central beam sections 10*c* could be provided between end male and female sections 0*m*, 10*f*, or a single beam section could be provided with a male connector at one end and a female connector at the other end.

Referring now to FIG. 2, the overall profile of half of the housing 18 is shown in cross section, the other half being substantially a mirror image (considering manufacturing tolerances etc.).

The base 12 comprises an outwardly extending flange 12*a* relative to the length of the beam 10) that is generally flat or inclined at a small angle to the horizontal. At its outermost limit, the base 12 is shaped such as to extend downwardly 12*c* and then back towards the central axis A-A of the housing 10, to form a cavity 13. The lowermost part 12*b* of the base 12 is substantially horizontal for placement on a road (B). The lowermost (and outermost) corner 12*c* of the base 12 is formed at an angle that will allow a vehicle wheel to ride up onto the base flange 12*a*.

The central wall 14 extends generally upwardly from the base flange 12*a* such that a lower portion 14*a* of the wall 14 extends at a relatively steep angle with respect to the base 12*a*. An upper portion 14*b* of the wall extends at approximately the same angle towards the top box 16. A step or shoulder 14*c* is provided between the lower wall portion 14*a* and the upper wall portion 14*b*, the step 14*c* providing a jump or discontinuity in the gradient of the otherwise planar wall 14. At the top of the upper wall portion 14*b*, the housing 18 extends outwardly, away from the central axis A-A, to form another step or lip 15. This is also shown in FIGS. 1*a* and 1*b*, which additionally shows that the lip 15 runs along the length of the beam 10. In the embodiment shown in FIG. 2, the angles of the shoulder 14*c* and lip 15 with respect to the horizontal are symmetrically opposite, and preferably shallow with respect to the horizontal. This provides for ease of manufacture. In an alternative embodiment (not shown), the angle of the shoulder 14*c* is steeper with respect to the horizontal than that of the lip 15.

By way of example, the step 14*c* may extend a distance of about 15 mm between the upper and lower walls 14, 14*b* and the lip 15 may extend a distance of about 15 mm between the upper wall 14*b* and the top box section 16.

The housing 18 then widens from the upper wall 14*b* into the top portion 16. The hollow housing 18 is preferably formed in two halves, a left skin as shown in FIG. 3 and a mirror-image right skin (not shown). Together, the two halves form a substantially symmetrical housing 18. The half-profiles of the housing 18 are shaped from (e.g. by bending or pressing) a sheet of material (e.g. metal and preferably steel) into the formation previously described. That is to say, each half-profile is a single, integrally formed, unit. At the centre 16*a* of the top portion 16, means (not shown) may be provided for linking the two halves of the profile together. In a preferred embodiment, the two skins are welded together. Alternatively, the housing 18 could be constructed as a single integral component.

An advantage of using sheets of metal to form the housing 18 is that the lip 15 and shoulder 14*c* that are bent into the sheet to profile the housing 18 add strength to the structure, without the need to add additional strengthening members, for the sheet/panel half-profile.

Several housings 18 and/or beams 10 may be stacked top-to-tail next to each other, i.e. by inserting one inverted housing 18/beam 10 between two adjacent upright housings 18/beams 10. Instead or as well, the housing shells (i.e. with no or few additional component parts provided internally thereof) may be configured to be stacked vertically on top of and within one another.

Referring to FIGS. 3*a* and 3*b*, a 'central' beam section 10*c* is shown. The central beam section 10*c* is provided at each end 17*c* with a jointing assembly 20*c*. The jointing assembly 20*c* of the central beam section 10*c* is attachable to a jointing assembly 20*c* of either a male end beam section 10*m* or a female end beam section 10*f*. That is to say, the jointing assemblies 20*c* provided at each end of the central beam section 10*c* are substantially the same (i.e. within manufacturing tolerances), and they are also substantially the same (i.e. within manufacturing tolerances) as the jointing assemblies 20*c* of the male/female beam section 10*m*, 10*f* to which the central beam section 10*c* is to be attached. In an alternative embodiment (not shown), two or more beam sections 10*c* may be joined together using jointing assemblies 12*c* with end beam sections 10*m*, 10*f* provided at either end thereof, to create a larger sectional barrier.

As mentioned above, the end beam sections 10*m*, 10*f* are configured to interlock with each other. Conveniently, the end beam sections 10*m*, 10*f* are provided (at the second ends thereof) with complementary male and female members that are inter-engageable with each other.

Figure 4A:
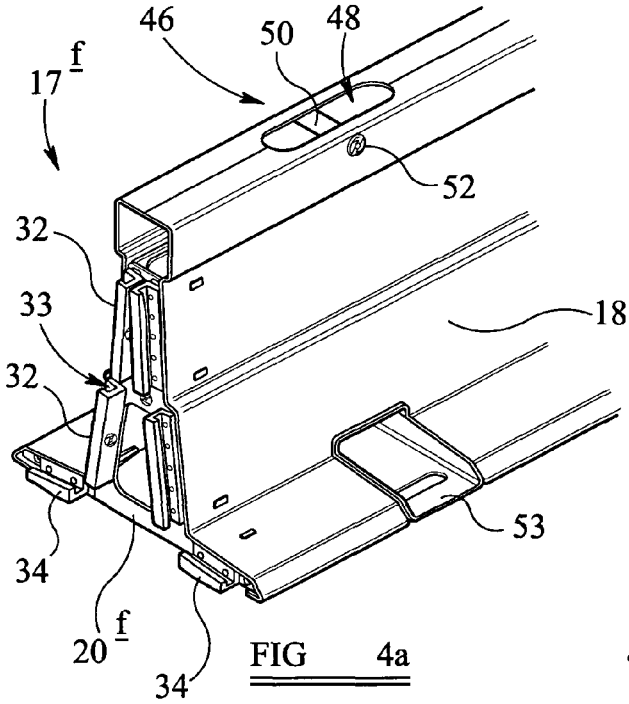
Figure 4B:
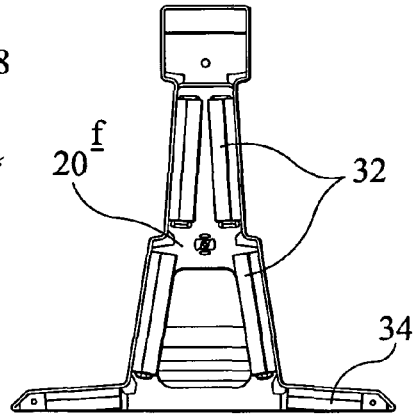
Figure 4C:
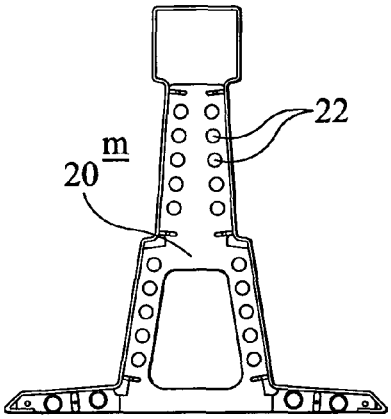
Figure 4D:
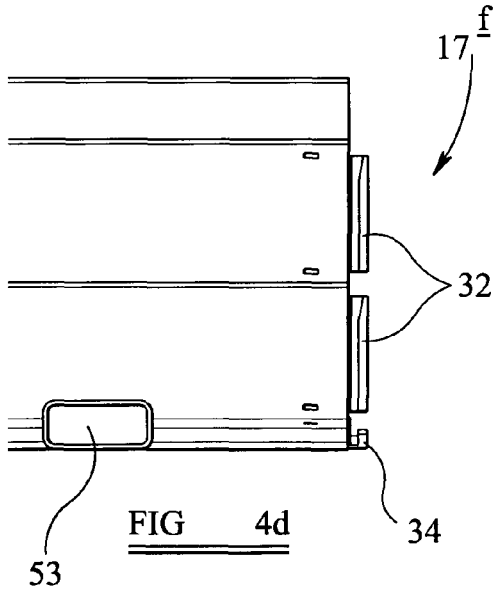

FIGS. 4*a* to 4*d* show the features of the 'female' end beam section 10*f*. The second end 17*f* of the female beam section 10*f* is provided with longitudinal connecting members 32 provided along the extremity of the wall portion 14 of the housing 18. The members 32 are j-shaped in cross-section, there being a channel 33 therewithin. The j-shaped members 32 extend along the majority of the length the wall 14. It is convenient to use two connectors 32 on each upwardly extending side of the wall 14, one provided on the lower wall portion 14*a* and one on the upper wall portion 14*b*, but any number of connectors 32 may be provided. Additional j-shaped connecting members 34 are provided along the lower surface of the base flange 12*a*. FIG. 4*d* shows a side view of the female end beam section 10*f*, from which it can be seen that the connectors 32, 34 protrude longitudinally beyond the end of the housing 18. The connectors 32, 34 do not, however, protrude laterally beyond the edge of the housing 18.

The connectors 32, 34 of the female beam section 10*f* are bolted to the joint assembly 20*f* with bolts 19 via apertures 22. The joint assembly 20*f* may be welded within housing 18 to secure it in place therewithin.

Figure 5A:
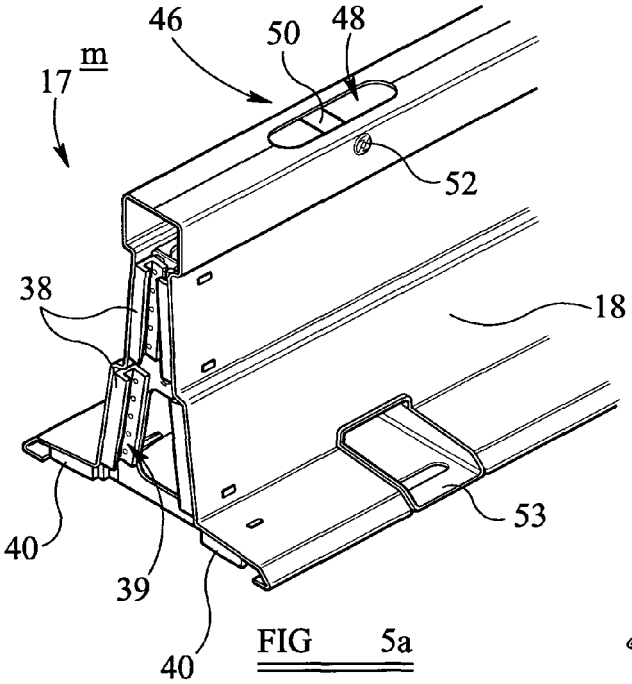
Figure 5B:
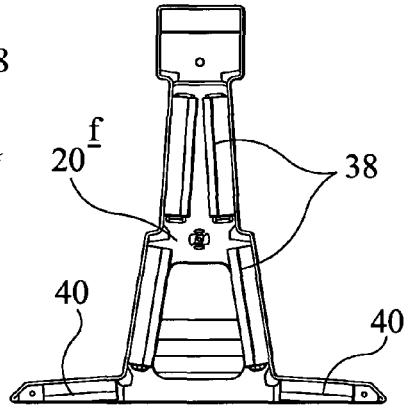
Figure 5C:
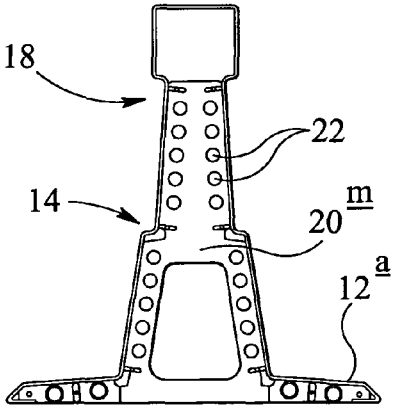
Figure 5D:
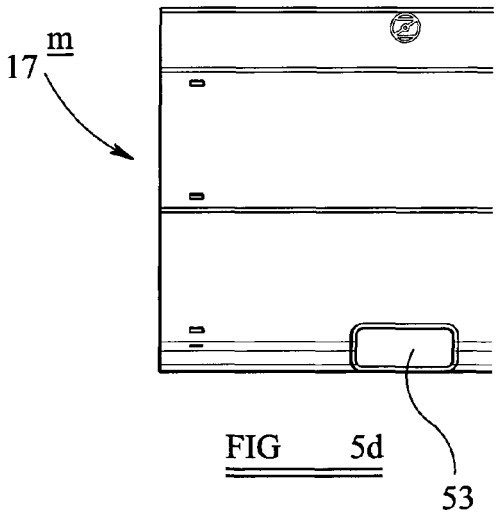

FIGS. 5*a* to 5*d* show the 'male' end beam section 10*m*. The male beam section 10*m* is provided with longitudinal connecting members 38 along the extremity of the wall portion 14 of the housing 18, as shown in FIGS. 5*a* and 5*b*. The connecting members 38 are j-shaped in cross-section, there being a channel 39 therewithin. The channels 39 of the j-shaped members 38 are sized to receive the connectors 32 of a female beam section 10*f*. The connectors 38 extend along the majority of the length the wall 14 and two members 38 are provided on each upwardly extending side of the wall 14, one provided on the lower wall portion 14*a* and one on the upper wall portion 14*b*. Additional j-shaped longitudinal members 40 are provided along the lower internal surface of the base flange 12*a*.

The connectors 38, 40 of the male beam section 10*m* are bolted to the joint assembly 20*m* with bolts 19 via apertures 22. The joint assembly 20*m* is welded within housing 18 to secure it in place therewithin. The connectors 38, 40 of the male beam section 10*m* do not protrude longitudinally beyond the end of the housing 18. Thus, the male connectors 38, 40 are housed within the housing 18.

Each of the male and female connectors 32, 38 are of substantially the same configuration, but oriented symmetrically and in a mirror-image manner with respect to each other. That is to say, the connectors 32, 38 of the male and female beam sections 10*m*, 10*f* respectively are mutually receivable within each other, to secure the two adjacent beam sections 10*m*, 10*f* together. The channel 33 of a female beam section 10*f* can receive the free end of the j-shaped member 38 of a male beam section 10*m* and, simultaneously, the channel 39 of the male beam section 10*m* can receive the free end of the j-shaped member 32 of the female beam section 10*f*.

Each of the additional connectors 34, 40 are also of substantially the same configuration, arranged in opposite orientations on each of the male and female beam sections 10*m*, 10*f* In the embodiment shown in FIGS. 4*a*-4*d* and 5*a*-5*d*, the channel formed by the j-shaped member 40 of the male beam section 10*m* opens downwardly and the channel formed by the j-shaped member 34 of the female beam section 10*f* opens upwardly. The j-shaped members 34, 40 are mutually receivable within each other, in a similar manner as previously described for the j-shaped members running along the wall 14 of the housing 18.

In an embodiment, the base j-shaped members 34, 40 may be shaped specifically to fit the left-hand and right-hand female beam section 10*f* as shown in FIG. 4*b* and the left-hand and right-hand male beam section 10*m* as shown in FIG. 5*b*. Alternatively, although not shown in the Figures, the same base j-shaped members 34, 40 may be used in each of these situations.

The j-shaped connectors 32, 34, 38, 40 are preferably formed from steel. It is desirable to coat the connectors 32, 34, 38, 40 with Geomet® or another similar product. The Geomet® coating advantageously provides for a more rapid changeover of damaged components compared with galvanised components. This is because, in the event of an impact on a barrier with galvanised components, there is a tendency for the components to adhere to each other—due to the back shock from the impact. This can make replacing damaged components difficult. By contrast, Geomet® has a low coefficient of friction, which means that, in the event of an impact, back shock does not cause the components to stick together—thus facilitating replacement of damaged parts. Furthermore, the process of coating components with Geomet® is environmentally friendly, since Geomet® contains no hexavalent chromium, and it is also applied by baking it on to steel components at low temperatures. A further advantage is that Geomet® coatings are thinner (6-8 microns) than galvanised coatings. The various fixings (e.g. screws, nuts, bolts, washers) utilised in the construction of the barrier may also be coated with Geomet® for the same reasons.

FIG. 6*a* shows a joint assembly 20*c* for provision at either end of a central beam section and/or at the first end of the male and female beam section 10*m*/10*f*. The joint assembly 20*c* comprises a central joint plate member 23*c* and two toes 25*c*. The central joint member 23*c* is joined to the toes 25*c*, preferably by welding. The outer profile of the joint assembly 20*c* substantially corresponds to the interior hollow of the housing 18. That is to say, the central plate 23*c* fills the space between the walls 14 and the top section 16. The toes 25*c* fill the cavities 13. When a central beam section 10*c* and a male/female beam section 10*m*/10*f* are joined together, their respective plates 23*c* are bolted together using bolts through the apertures 22. The plates 23*c*, which are welded around their edges to the interior of the housing 18, also provide a means for preventing the two halves of the housing 18 from disengaging. Advantageously, the same central joint member 23*c* can be used for each of the central beam sections 10*c* and the first ends of the male and female beam sections 10*m*, 10*f*. The central joint 23*c* is also symmetrical about axis A-A (see FIG. 2), meaning that it can be used either way round with respect to the axis A-A, thus facilitating installation within the housing.

FIG. 6*b* shows a joint assembly 20*m*, 20*f* for provision at the second end 17*m*, 17*f* of a male/female beam section 10*m*, 10*f*. The joint assembly 20*m*, 20*f* is similar to that of the central beam section 10*f*, with a central joint plate member 22*m*, 23*f* and two toes 25*m*, 25*f*. The central member 22*m*, 23*f* is again joined to the toes 25*m*, 25*f*, preferably by welding. The outer profile of the assembly 20*m*, 20*f* substantially corresponds to the interior hollow of the housing 18. That is to say, the central plate 22*m*, 23*f* fills the space between the walls 14. The toes 25*m*, 25*f* fill the cavities 13. However, there is no plate section to fill the top box part 16 of the housing 18.

Advantageously, the same central joint member 22*m*, 23*f* can be used for each of the second ends of the male and female beam sections 10*m*, 10*f*. It is symmetrical about axis A-A (see FIG. 2), meaning that it can be used either way round with respect to the axis A-A, thus facilitating installation within the housing.

The toes 25*c*, 25*m*, 25*f* are common to each of the central, male and female beam sections 10*c*, 10*m*, 10*f*. It is thus convenient that the same toes 25*c*, 25*m*, 25*f* can be welded to each of the central joint members 23*c* and 22*m*, 23*f*.

The central plates 23*c*, 22*m*, 23*f* are partially cut away to provide openings 27*c*, 27*m*, 27*f*. This aids in keeping the mass of the plates 23*c*, 22*m*, 23*f* down. It also enables the barrier to crumple in the event of an impact thereon, to absorb energy therefrom, so as to ensure the barrier is not too stiff to cause a danger in the event of an impact. The toes 25*c*, 25*m*, 25*f* may be manufactured from the portion of material removed to form the opening 27*c*, 27*m*, 27*f* in the plate 23*c*, 22*m*, 23*f*.

FIG. 7*a* shows the junction 24 between ends 17*c* of a central beam section 10*c* and an end beam section 10*m*. The joint assemblies 20*c* of each beam section 10*c*, 10*m* are bolted together with bolts 19. Gussets 21 are provided to reinforce the connection between the two beam sections 10*c*, 10*m*, and to create a flow path to dissipate load/force up and down the barrier in the event of an impact. As can be seen from FIG. 7*b*, the gussets 21 are generally triangular in shape, with tabs 21*t* that fit into slots 21*j* in the joint assemblies and slots 21*h* in the housing 18. The central beam section 10*c* is joined to a female beam section 10*f* in the same way as described above for joining the male beam section 10*m* to the central beam section 10*c*.

It is very convenient that each of the male and female connectors for adjacent beams are formed from commonly shaped component parts (the jointing plate 22*m*, 23*f* and the j-shaped connectors 32, 38.

The interlocking between a male beam section 10*m* and a female beam section 10*f* is such that on attempting to engage a male beam section 10*m* with a female beam section 10*f*, the beam sections 10*m*, 10*f* are substantially self-aligning with respect to each other. Since the female connectors 38, 40 protrude from the end of the housing 18 and the male connectors 32, 34 are housed within the housing 18, the external surfaces of the housings 18 of joined beam sections 10*m*, 10*f* are substantially flush.

The self-aligning, end-to-end engagement of adjacent beam sections 10*m*, 10*f* provides the advantage that no tools are required in the joining thereof, and no loose component parts are required to fix them together. In order to connect the two beam sections 10*m*, 10*f* together, the male beam section 10*m* is lifted onto the connectors 32 of the female beam section 10*f*. Since the base 12 of the male beam section 10*m* is wider than the upper parts 14, 16 of the female beam section 10*f*, there is no need to accurately locate one onto the other—the female connectors 32, 34 and male connectors 38, 40 will tend to locate themselves with respect to each other. Once in position, the male and female wall connectors 32, 38 interlock and the male and female base connectors 34, 40 interlock. The two sets of male/female connections ensure that the beam sections 10*m*, 10*f* are laterally and vertically positioned correctly with respect to each other. Furthermore, additional barrier strength is provided on interlocking male and female beam sections 10*m*, 10*f* because the joint stiffness is increased.

Furthermore, since the connectors 32, 34, 38, 40 are simply bolted onto the joint assemblies 20*m*, 20*f*, the connectors 32, 34, 38, 40 are easy to replace if necessary, and a wide range of connectors 32, 34, 38, 40 of various shapes and sizes can be interchanged between different beam sections, for example. This also allows alternative interfaces to be fitted, such as to provide attachment to other components such as crash cushions etc. Furthermore, these components are simple and inexpensive to manufacture.

FIG. 8 shows a locking unit 70, which may be provided within the open ends of the box section 16 of adjacent male and female beam sections 10*m*, 10*f*. The locking unit 70 is configured to bridge the join of adjacent male and female beam sections 10*m*, 10*f*, to aid alignment thereof and to retain them in their correct positions. The locking unit 70 comprises a location member 72 and a guidance member 74 connected via legs 76. Conveniently, the locking unit 70 sits fully within the top box section 16 of a female beam section 10*f* and, when a male beam section 10*m* is placed adjacent thereto, the locking unit 70 is slidable into the top box section 16 of the male beam section 10*m*. The locking unit then bridges the top box sections 16 of the male and female beam sections 10*m*, 10*f*.

The location member 72 is u-shaped in cross section, and the legs 76 are attached to each free end of the u-shaped location member 72. The guidance member 74 is attached to the free ends of the legs 76 and extends upwardly, perpendicular with respect to the legs 76. The location member 72 comprises opposing surfaces 72*a*, the corners 72*b* of which are chamfered to assist in auto-alignment with an adjacent male beam section 10*m*. The upstanding guidance member 74 protrudes through an aperture 48 in the housing of the female beam section 10*f* (see FIG. 3*a*). The aperture 48 is elongate, and the guidance member 74 can be moved along the length of the aperture 48 to move the locking member 70 from a position in which it is fully retracted within the female beam section 10*f* to a position in which it bridges adjacent male and female beam sections 10*m*, 20*f*.

Referring to FIGS. 1*a*, 3*a*, 4*a* and 5*a*, lifting points 46 are shown, provided in the uppermost portion 16*a* of the top box housing 16. Each lifting point 46 is configured so that a hook, chains, ropes etc. can be attached thereto, for lifting the beam sections 10*c*, 10*m*, 10*f* into and out of position on the road or otherwise.

The lifting point 46 comprises the aperture 48 in the uppermost surface of the top box section 16. A lifting bar 50 extends laterally outwardly with respect to the central axis A-A of the beam section 10*c*, 10*m*, 10*f*. The bar 50 is located within the top box section 16, and secured to the opposing sides thereof e.g. by bolts, studs 52 or the like. The concealment of the lifting point 46 within the box section 16 reduces the likelihood of damage to impacting vehicles and reduces the likelihood of damage by a vehicle to the lifting point 46. The lifting bar 50 further adds strength to the box section 16, and aids in preventing crushing of the box section in the event of an impact. The lifting bar 50 also acts as a stop for movement of the locking unit 70, to prevent the locking unit being pushed too far out of the female beam section 10*f*.

As can be seen form FIG. 1*a*, three lifting points 46 are provided spaced along the length of each of the beam sections 10*c*, 10*m*, 10*f*. When the three beam sections 10*c*, 10*m*, 10*f* are joined together (as in FIG. 1*a*), the beam 10 will have nine lifting points 46. The lifting points 46 may be configured for use with multiple forms of lifting and handling equipment. In the embodiment shown, each beam section 10*c*, 10*m*, 10*f* may be lifted by the central lifting point 46, as a pivot during assembly to level the beam section 10*c*, 10*m*, 10*f* and to lift over obstacles such as hills etc.

In an alternative embodiment (not shown) comprising two beam sections connected to provide male and female connectors at the ends thereof, each of the two beams may again be provided with lifting points 46. For example, two lifting points 46 may be provided spaced along the length of each beam section, providing four lifting points for the assembly. In this embodiment it is convenient to lift the barrier using the inner lifting points 46 of the outer two beams, as this enables the beam to be lifted by just two lifting points 46, whilst spanning the majority of the length of the assembled beams. It will be appreciated that any number of lifting points may be provided on at least one, some or all of the beam sections 10*c*, 10*m*, 10*f*.

Referring to FIGS. 9*a*, 9*b* and 9*c*, a lifting insert 54 is shown. This insert 54 is designed to be secured (preferably by welding) within a drainage channel 53 (as shown in FIGS. 1*a* and 2*a*, for example). The drainage channels 53 are provided in the base 12, extending through the full lateral width of the beam 10. These allow water to pass from one side of the barrier to the other.

The insert 54 has a passage 57 defined by a base 55 underneath a central bridge 59, the passage 57 extending from one side of the insert 54 to the other and therefore, when welded into the base 12 of a beam section 10*c*, 10*m*, 10*f*, from one side of the beam section 10*c*, 10*m*, 10*f* to the other. The beam section 10*c*, 10*m*, 10*f* may be lifted from its upright position by a fork lift truck, the fork(s) being insertable into either side of the passage 57 of the lifting insert 54.

An aperture 58 is provided in the base 55 of the lifting insert 54. When in its inverted form, a beam section 10*c*, 10*m*, 10*f* may be lifted using a lifting dog that passes through the aperture 58. Alternatively, the insert 54 may be provided with tongues (not shown) that are welded to and extend outwardly from each side of the central bridge 59 of the insert 54, in the direction of the length of the beam section 10*c*, 10*m*, 10*f*. The tongues facilitate centring of lifting straps or chains and to ensure that the lifting straps/chains do not slip during lifting. The tongues therefore ensure that the beam section 10*c*, 10*m*, 10*f*/beam 10 is maintained in a stable position during lifting thereof. Alternatively, the tongues 58 are provided only on one side of the insert 54. This provides the advantage that the overall insert can be used in either orientation within the housing by simply rotating it by 180°, saving materials in production whilst still providing guide means for lifting where needed.

Lifting the beam section 10*c*, 10*m*, 10*f* or beam 10 via the inserts 54 allows the beam sections 10*c*, 10*m*, 10*f* or beam 10 to be lifted from an inverted position or a position in which it is lying on its side. The insert 54 may be constructed from a single box section. However, in the embodiment shown in FIG. 9*a*, the insert 54 is manufactured from a long piece of metal to form the lower part 55 of the insert 54, and a shorter piece of metal 59 welded on top of the lower piece 55. Production in this way is more efficient, as simply shaped pieces of metal may be used, meaning that there is little wastage in production.

Apertures 56 are also provided in the insert 54, for optionally anchoring the barrier to a road or other surface. Preferably, the apertures 56 are elongate (e.g. slots) in a direction transverse to the direction of the lifting insert 54 (i.e. run parallel with the longitudinal direction of the road). The slots 56 allow for expansion and/or contraction of the road due to temperature fluctuations that cause the road surface to expand/contract.

The inserts 54 are preferably formed from metal, such as steel, and are preferably galvanised. Apertures 59*a* are provided in the bridge 59, for galvanising drainage during manufacture of the lifting insert 54. The inserts 54 advantageously provide the functions of providing means 53 for drainage and means for lifting the beam sections 10*c*, 10*m*, 10*f* (from an upright position using a fork lift truck or from any other position using lifting dogs/straps/chains), as well as strengthening the base 12 of the beam sections 10*c*, 10*m*, 10*f*.

Referring again to FIG. 1*b*, the underside of a beam 10 is shown. Rubber feet or pads 60 (as also shown in FIG. 10) may be provided on the underside of the insert 54, for contacting the road surface. The rubber feet 60 are preferably bonded directly to the metal insert 54, to ensure maximum strength of the connection therebetween. The rubber feet 60 extend the lateral width of the housing 18, and increase the frictional grip of the beam 10 with the road surface, to minimise deflection of the barrier on impact from a vehicle (in comparison to a metal surface being in contact with the road surface). Furthermore, the rubber feet 60 minimise the chance of the beam sinking in to the road surface, as they act to spread the load of the barrier and reduce the pressure applied to the road by and through the barrier at the points of contact therebetween. This is particularly so in hot climates. Attaching rubber feet 60 to the underside of the inserts also raises the height of the barrier with respect to the road surface, thus improving drainage, and minimise the chance of water corroding the metal barrier.

The rubber pads 60 as shown in FIG. 10 are injection moulded, single-piece rubber pads. Recesses 61 of varying shapes and thicknesses are provided within the rubber pads. The recesses 61 help to ensure good contact with the road surface, even though there might be debris such as stones loose on the road that may otherwise reduce the contact of a flat rubber surface with the road. Apertures 56*a*, 58*a*, corresponding to the apertures 56, 58 in the feet 54 are also provided.

FIG. 11 shows a strengthening web 62, which is provided within the cavity defined by the opposing walls 14 of the housing 18 (as shown in FIGS. 1*b* and 3*b*). The web 62 is sized to fit the internal profile defined by the opposing walls of the housing 18, this being dictated by the lower and upper walls 14*a*, 14*b* and the shoulder 14*c*. The web 62 provides additional stiffness to the profile, and supports the sidewalls 14 in the event of an impact. In the embodiment shown in FIG. 11, cut-outs 63 are provided within the web 62, similar to those provided in the joint assembly plates 23*c*, 22*m*, 23*f*. This aids in keeping the mass of the plates webs 62 down. It also enables the barrier to crumple in the event of an impact thereon, to absorb energy therefrom, so as to ensure the barrier is not too stiff to cause a danger in the event of an impact.

In an embodiment, and as shown for example in FIGS. 1*a*, 1*b*, 3*a* and 3*b*, cavities or apertures 80 may be provided within the housing 18, allowing access to the interior of the housing. This enables a person manufacturing the beam sections 10, 10' to weld the web 62 within the housing from outside the housing 18.

Various references have been made above to fixing components together with bolts. It is desirable to use Scotchgrip™ resin, or a similar product, on the bolts. The Scotchgrip™ resin is a two-part adhesive, which is mixed together when the bolt is being screwed into place. Providing the holes into which a bolt is being screwed with a countersink aids in the mixing by providing a surface against which the two parts can be pressed. This creates an adhesive on the threads of the bolts to provide additional strength to the fixings.

In use, the crash barrier beam sections 10*m*, 10*c*, 10*f* are joined together by fixing together adjacent central and end plates 20*c*, 20*m*; 20*c*, 20*f* at ends 17*c* thereof and/or a plurality of beams 10 are interlocked at corresponding ends 17*m*, 17*f* thereof which mate together as described above. The resulting structure (referred to from now on as the barrier) is placed on a road, by lifting the individual beam sections 10*c*, 10*m*, 10*f* and/or beams 10 as discussed earlier and securing them together on site.

The barrier is thus particularly suited to temporary use, for example at road works, to cordon off a particular area of road or divide vehicle carriageways for contraflows etc. The combined weight of the individual barrier beam sections 10*c*, 10*m*, 10*f* and beams 10 act together to stabilise the barrier in the desired position. Furthermore, the relative sizes of the base 12 to the central walled portion 14 and top portion 16 provide stability to the lengths of beams/barrier, thus providing a lesser 'working width' in comparison to known temporary road barriers. That is to say, the beams 10 have a wide base onto which a vehicle wheel can ride, but the lateral width that the 'fence' part of the beam 10 occupies is smaller. The beam sections 10*c*, 10*m*, 10*f*/beams 10 have a low centre of gravity, resulting in a reduced net gain in energy by an impacting vehicle when it rolls over the base 12. This arrangement provides the further advantage that the barrier may be deployed closer to traffic lanes than barriers with wider bases. In the embodiment shown in the Figures, the centre of gravity is very low (about 0.32 m above the ground), due to the presence of more material below the centre of gravity than above it. This is achieved by the provision of the cutout apertures 27*c*, 27*m*, 27*f* in the jointing assemblies 20*c*, 20*m*, 20*f*. It has been found that the beam remains stable (i.e. does not topple or roll over) when tilted to substantially 48° with respect to the vertical. This arrangement helps stop the barrier overturning in the event of a vehicle impacting upon it.

The turnover 12*c* of the metal sheet to form the cavity 13 provides additional stiffness to the barrier, and the toes 25*c*, 25*m*, 25*f* help maintain the turnover profile. The turnover 12*c* further reduces the pressure loading on the road surface, for example, if the rubber feet 60 are not provided.

In the event of an impact, one or more wheels of a vehicle approaching the barrier will ride up onto the base 12 of the housing 18. The weight of the vehicle provides an additional down force on the base 12, thus providing further stability to the barrier in the event of an impact. The stepped profile given to the housing 18 by the shoulder 14*c* not only helps to stiffen the wall 14 of the housing 18, it assists in redirecting a wheel of a vehicle that is riding up the barrier. In the event that a vehicle wheel rolls all of the way up the sidewall 14 to contact the top lip 15, the wheel will be redirected back towards the ground to restrain the impacting vehicle in the carriageway.

The combined action of the shoulder 14*c* and the lip 15 act to urge the vehicle wheel back into the carriageway, away from the barrier.

Advantageously, the profile of the beam sections 10*c*, 10*m*, 10*f* and the length of engagement of the interlocking male and female connectors 32, 38 mean that the barrier must be lifted to a significant height before any joint disengagement will occur. The locking member 70 further aids in keeping adjacent male and female beam sections 10*m*, 10*f* joined together.

Furthermore, in the event of a vehicle drifting into the barrier, e.g. if the driver of the vehicle is tired, the initial contact with the wide base 12 may be sufficient to warn the driver to take action to avoid full collision with the barrier.

It will be appreciated by persons skilled in the art that various modifications may be made to the above-described embodiments without departing from the scope of the present invention. It will also be appreciated that the features described herein may be taken separately and in any and all combinations in order to provide a barrier that is tailored for a particular use. Furthermore, whilst embodiments of the present invention are particularly suited for use as a temporary crash barrier, it will be appreciated that the beam sections/beams could also be permanently fixed to the road surface.

The invention claimed is:

1. A crash barrier beam suitable for temporary placement on a road, the beam comprising a housing which in profile has a laterally extending base for contact with the road, the base being substantially flat or inclined at an angle to the horizontal, an impact wall comprising a lower wall section and an upper wall section, and a top section having a box-like cross-section, the impact wall extending upwardly at an angle from the base to taper towards the top section, wherein the impact wall has an inwardly directed stepped deflection running along the length of the beam between the lower wall section and the upper wall section, and an outwardly directed stepped deflection running along the length of the beam where the impact wall meets the top section, the inwardly and outwardly stepped deflections being on angle with respect to the horizontal, and wherein the base, the impact wall and the top section are formed from a single sheet of material or from a pair of opposed mirror image sheets of material joined at the top section to provide a continuous impact surface to an impacting vehicle and, in the event of an impact, the gradient of the impact wall and the inwardly and outwardly stepped deflections assist in redirecting an impacting vehicle wheel back towards the carriageway away from the barrier.

2. The beam of claim 1, wherein the angles of the inwardly stepped deflection and the outwardly stepped deflection with respect to the horizontal are symmetrically opposite.

3. The beam of claim 1, wherein the inwardly and outwardly stepped deflections define respective surfaces that face one another.

4. The beam of claim 1, wherein the inwardly and outwardly stepped deflections extends a distance of approximately 15 mm between the upper and lower walls and between the upper wall and top section respectively.

5. The beam of claim 1, wherein the inwardly and outwardly stepped deflections are bent or pressed into the sheet material to provide stiffness to the impact wall.

6. The beam of claim 1, wherein the base terminates in an inwardly extending toe for supporting the beam.

7. The beam of claim 6, wherein toe infills are provided within the said toe to provide additional strength and rigidity to the base of the beam.

* * * * *